US011036183B2

(12) United States Patent
Macias Garza

(10) Patent No.: US 11,036,183 B2
(45) Date of Patent: Jun. 15, 2021

(54) WATCH WINDING APPARATUS FOR WINDING A WRIST WATCH AND METHOD THEREOF

(71) Applicant: Fernando Macias Garza, Austin, TX (US)

(72) Inventor: Fernando Macias Garza, Austin, TX (US)

( * ) Notice: Subject to any disclaimer, the term of this patent is extended or adjusted under 35 U.S.C. 154(b) by 0 days.

(21) Appl. No.: 16/861,108

(22) Filed: Apr. 28, 2020

(65) Prior Publication Data

US 2021/0003970 A1 Jan. 7, 2021

Related U.S. Application Data

(63) Continuation of application No. 16/460,171, filed on Jul. 2, 2019, now Pat. No. 10,642,224.

(51) Int. Cl.
*G04B 5/04* (2006.01)

(52) U.S. Cl.
CPC ..... *G04B 5/04* (2013.01)

(58) Field of Classification Search
CPC ..... G04B 5/04; G04B 18/021; G04D 7/009; G04D 7/1264; G04D 7/1278
See application file for complete search history.

(56) References Cited

U.S. PATENT DOCUMENTS

| | | | |
|---|---|---|---|
| 2,917,955 | A | 12/1959 | Leger |
| 7,205,788 | B1 | 4/2007 | Terzian |
| 7,270,474 | B2 | 9/2007 | Agnoff |
| 9,223,294 | B2 | 12/2015 | Ng |
| 2005/0254352 | A1 | 11/2005 | Wolf |
| 2005/0265129 | A1 | 12/2005 | Agnoff |
| 2007/0159929 | A1 | 7/2007 | Louie |
| 2007/0223319 | A1 | 9/2007 | Hill |
| 2008/0247278 | A1 | 10/2008 | Walker |
| 2011/0026374 | A1 | 2/2011 | Chang |
| 2012/0269045 | A1 | 10/2012 | Balter |
| 2015/0227114 | A1 | 8/2015 | Perrinjaquet |
| 2018/0341226 | A1 | 11/2018 | Favre |

*Primary Examiner* — Edwin A. Leon
*Assistant Examiner* — Jason M Collins
(74) *Attorney, Agent, or Firm* — Hulsey P.C.

(57) ABSTRACT

A watch winding apparatus for winding a wrist watch with mechanical self-winding eccentrics and having a bracelet is provided. The watch winding apparatus includes a carrier adapted for mounting the wrist watch therein. The carrier also includes a bracelet holding mechanism arranged inside a hollow cylindrical housing, which in an open position thereof is disposed providing a gap with respect to an inner wall, and in the closed position thereof is disposed with the said gap being narrower with respect to the inner wall. The carrier is adapted to receive the wrist watch therein with the bracelet being slided through the said gap and being snugly supported with the bracelet holding mechanism disposed in the closed position thereof. Further, the watch winding apparatus includes a rocker device configured to rotate the carrier to activate the mechanical self-winding eccentrics for winding of the wrist watch mounted therein.

19 Claims, 16 Drawing Sheets

WATCH WINDING APPARATUS FOR WINDING A WRIST WATCH AND METHOD THEREOF

The present application is a continuation of U.S. application Ser. No. 16/460,171, filed Jul. 2, 2019; all of which is incorporated by reference herein.

FIELD OF THE INVENTION

The present disclosure relates to a watch winding apparatus and a method for winding a wrist watch with mechanical self-winding eccentrics and, more particularly to a carrier for a wrist watch which allows to place the wrist watch therein with minimal effort without the need to close a bracelet.

BACKGROUND OF THE INVENTION

A self-winding watch, also known as an automatic watch, is a mechanical watch in which the natural motion of the wearer provides energy to run the watch, making manual winding unnecessary. Such watch winds itself using a weight inside the watch that oscillates to put tension on the mainspring through the random motion of the watch wearer's arm. Generally, in a mechanical watch the watch's gears are turned by a spiral spring called a mainspring. In a manual watch energy is stored in the mainspring by turning a knob, the crown on the side of the watch, winding the mainspring. Then the energy from the mainspring powers the watch movement until it runs down, requiring the spring to be wound again. The self-winding watch movement has a mechanism which winds the mainspring using the natural motions of the wearer's body. The watch contains an oscillating weight that turns on a pivot. The normal movements of the watch in the user's pocket or on the user's arm cause the rotor to pivot on its staff, which is attached to a ratcheted winding mechanism. The motion of the watch is thereby translated into circular motion of the weight which, through a series of reverser and reducing gears, eventually winds the mainspring.

Generally, the self-winding watches include a rotor and a reverser mechanism. The rotor is a semi-circular weight that is mounted on the movement, and is sometimes also known as the oscillating weight. The rotor swings through 360° thanks to the movements of the watch on the wrist. Through a series of gears, the movement of the rotor winds the mainspring which supplies the watch with mechanical energy. The reverser mechanism sits between the rotor and the gears, and enables the rotor to wind the mainspring no matter which way it turns. Various reverser mechanisms exist, the best-known being the pawl-winding system. This comprises two wheels, each made up of a top disc and a bottom disc. These discs are connected by a spring-less pawl that unclicks one wheel then the other depending on the direction of rotation.

When completely wound, the mainspring will generally have sufficient energy to run the watch for up to 12 to 48 hours, depending on the particular type of watch. Therefore, it will be appreciated that when the watch is not being worn for a sufficiently long period of time, the energy in the mainspring will tend to run down or completely dissipate. Once the spring is unwound, a self-winding watch generally cannot be fully rewound in a few seconds. The task of rewinding a self-winding watch can be a major inconvenience, as it may include resetting the time, dates and numerous other functions, or "complications," each time the spring runs down. Often watch collectors and stores have multiple such watches which need to be wound, and thus the task becomes even more cumbersome when multiple watches are involved.

Some watch winders are known for keeping self-winding watches wound when not in use. Watch winders are mechanical devices that can simulate the aforesaid natural motion to keep the so-called "automatic watch" or "self-winding watch" that is stored in the watch winder operating smoothly for those who don't wear their watch every day and/or won't wear their watch for a long time. Various automatic watch-winders for keeping self-winding watches wound when not in use are currently available. A typical watch-winder, or so-called watch rotator, includes a motor-driven spindle, drum or other structure adapted to hold and rotate a watch about an axis. During rotation about an axis perpendicular to the watch face, for example, the pendulum of the watch will hang downwardly under gravity, and the watch will rotate about the stationary pendulum, causing the mainspring to stay wound.

Such commercial watch winders often require a significant effort on part of the user to place the watch for winding thereof. For a commercial winder, which holds the watch with a cushy pillow-like holder, the process is the following. First the user needs to untie/unlock the watch (e.g., from user's wrist). Then, the bracelet of the watch is put around the pillow. Thereafter, the bracelet is tied or locked around the pillow. If the watch bracelet has a mechanical closure, this step is relatively less cumbersome; however, if the watch has a buckle, this process can be hard, especially for people with diminished motor skills. Thereafter, the watch is wound in the watch winder and the process is reversed. That is, the bracelet is untied/unlocked from pillow, which again may be cumbersome for the user.

Therefore, there is a need of a simple apparatus for winding of an automatic watch, and which allows the watch to be placed therein with ease.

BRIEF SUMMARY OF THE INVENTION

The disclosed subject matter provides watch winding apparatus for winding a wrist watch with mechanical self-winding eccentrics and having a bracelet. According to one aspect of the present disclosure here is provided watch winding apparatus that includes a carrier adapted for mounting the wrist watch therein. The carrier includes a hollow cylindrical housing with an inner wall. The carrier also includes a bracelet holding mechanism arranged inside the hollow cylindrical housing. The bracelet holding mechanism is adapted to be switched between a closed position and an open position such that in the open position thereof, the bracelet holding mechanism is disposed providing a gap with respect to the inner wall, and in the closed position thereof, the bracelet holding mechanism is disposed with the said gap being narrower with respect to the inner wall. The carrier is adapted to receive the wrist watch therein with the bracelet being slided through the said gap between the bracelet holding mechanism and the inner wall while the bracelet holding mechanism disposed in the open position thereof, and the bracelet being snugly supported in the gap with the bracelet holding mechanism disposed in the closed position thereof. Further, the watch winding apparatus includes a rocker device adapted to allow placement of the carrier thereon. The rocker device is configured to rotate the carrier, based on user-configurable setting, to activate the mechanical self-winding eccentrics for winding of the wrist watch mounted therein.

The presently disclosed watch winding apparatus uses a spring-loaded bistable mechanism for the bracelet holding mechanism. The bracelet holding mechanism further comprises one cushioning piece lined on one side thereof facing the inner wall, and another cushioning piece lined on corresponding portion of the inner wall, to snugly support the bracelet between the two cushioning pieces. The carrier comprises a pillar arranged with respect to the bracelet holding mechanism such that the wrist watch rests on the pillar when mounted in the carrier with the bracelet extending from sides of the pillar towards the bracelet holding mechanism.

Another technical feature of the presently disclosed watch winding apparatus is that the carrier is a two-piece structure. The carrier comprises a first half-cylindrical structure having the bracelet holding mechanism arranged therein and the pillar arranged therein, and one or more pin sleeves arranged along distal peripheral face thereof. The carrier also comprises a second half-cylindrical structure having one or more pins, corresponding to the one or more pin sleeves, arranged along a distal peripheral face thereof. Herein, the second half-cylindrical structure is adapted to slide onto the first half-cylindrical structure such that the one or more pins are received in the corresponding one or more pin sleeves to align the distal peripheral face of the first half-cylindrical structure with the distal peripheral face of the second half-cylindrical structure, thereby making it easy to combine the two half-cylindrical structures into one cylindrical structure to be placed on the rocker device. The watch winding apparatus comprises a catch mechanism provided between the first half-cylindrical structure and the second half-cylindrical structure to releasably couple the first half-cylindrical structure and the second half-cylindrical structure, in the carrier.

A further technical feature of the presently disclosed watch winding apparatus is that the rocker device uses an actuation mechanism for automatic winding of the wrist watch. The rocker device comprises a first block with a rolling surface adapted to allow placement of the carrier thereon, and a second block pivotally supporting the first block thereon. The actuation mechanism is arranged between the first block and the second block, the actuation mechanism configured to cause rocking of the first block, with respect to the second block, such that the carrier placed on the rolling surface is rolled between two ends thereof and rotate thereby.

The actuation mechanism comprises an actuator fixed to a top side of the second block from one end thereof and to a bottom side of the first block from other end thereof, wherein the actuator is configured to extend and retract, based on user-configurable setting, to cause rocking of the first block; and at least one limit switch provided on the top side of the second block such that the at least one limit switch is depressed when the bottom side of the first block comes in contact with the top side of the second block while rocking, wherein the at least one limit switch generates a signal on depression thereof to cause the actuator to switch from extension thereof to retraction and vice-versa A further technical advantage of the watch winding apparatus includes that the rolling surface have guide rails defined therein to prevent the carrier from rolling off from lateral sides thereof. Further, the rolling surface is curved to prevent the carrier from rolling off from the longitudinal ends thereof.

According to another aspect of the present disclosure here is provided a method for winding a wrist watch with mechanical self-winding eccentrics and having a bracelet. The method comprises mounting the wrist watch in a carrier. This involves resting the wrist watch on the pillar in the carrier with the bracelet extending from sides of the pillar to be engaged by a bracelet holding mechanism. The method further includes placing the carrier, with the wrist watch, on a rolling surface of a rocker device. The method further includes actuating the rocker device, based on user-configurable setting, to cause rolling, and thereby rotation, of the carrier on the rolling surface, to activate the mechanical self-winding eccentrics for winding of the wrist watch mounted therein.

Still further technical aspects and advantages of the presently disclosed watch winding apparatus and method for winding a wrist watch will become apparent upon reading the technical description and considering the claims appearing below.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the FIGUREs and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

Although the present disclosure provides a description of watch winding apparatus for winding wrist watch with mechanical self-winding eccentrics, it should be understood that the description is by way of example only and is not to be construed in a limiting sense. It is to be further understood, therefore, that numerous changes may arise in the details of the embodiments of this watch winding apparatus with carrier adapted for mounting the wrist watch therein and rocker device configured to rotate the carrier, and further method for winding wrist watch. It is contemplated that all such changes and additional embodiments are within the spirit and true scope of this disclosed method and system as claimed below.

Figure 1:
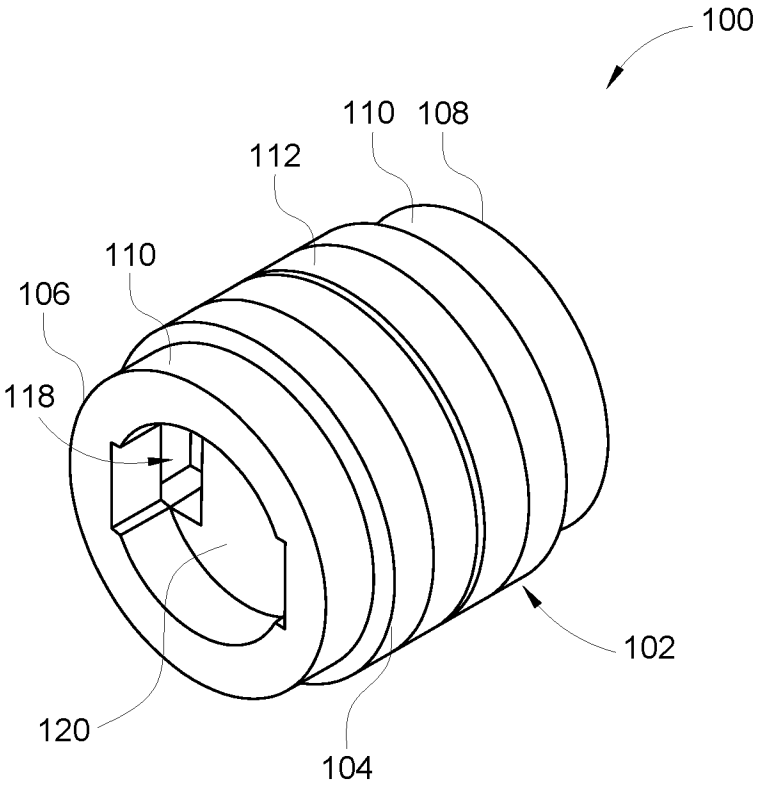
FIG. 1 illustrates a perspective view of a carrier for holding a wrist watch.

FIG. 1 illustrates a perspective view of a carrier 100 for holding a wrist watch (not shown). The carrier 100 includes a housing 102 which is generally a cylindrical structure. In one example, the housing 102 is made of wood, or specifically polished wood. In other examples, the housing 102 may be made of any other suitable material including, for example, plastic, glass, stainless steel, or the like without any limitations. The housing 102 may be provided with ornamental design features for enhancing the appeal thereof. The housing 102 may be polished in any suitable color depending on the required or desired aesthetics of the carrier 100. Generally, an outer surface 104 of the housing 102 may be kept smooth to have low friction for allowing rolling, and thereby rotation, of the carrier 100 on a rolling surface (as discussed later in the description).

Figure 2:
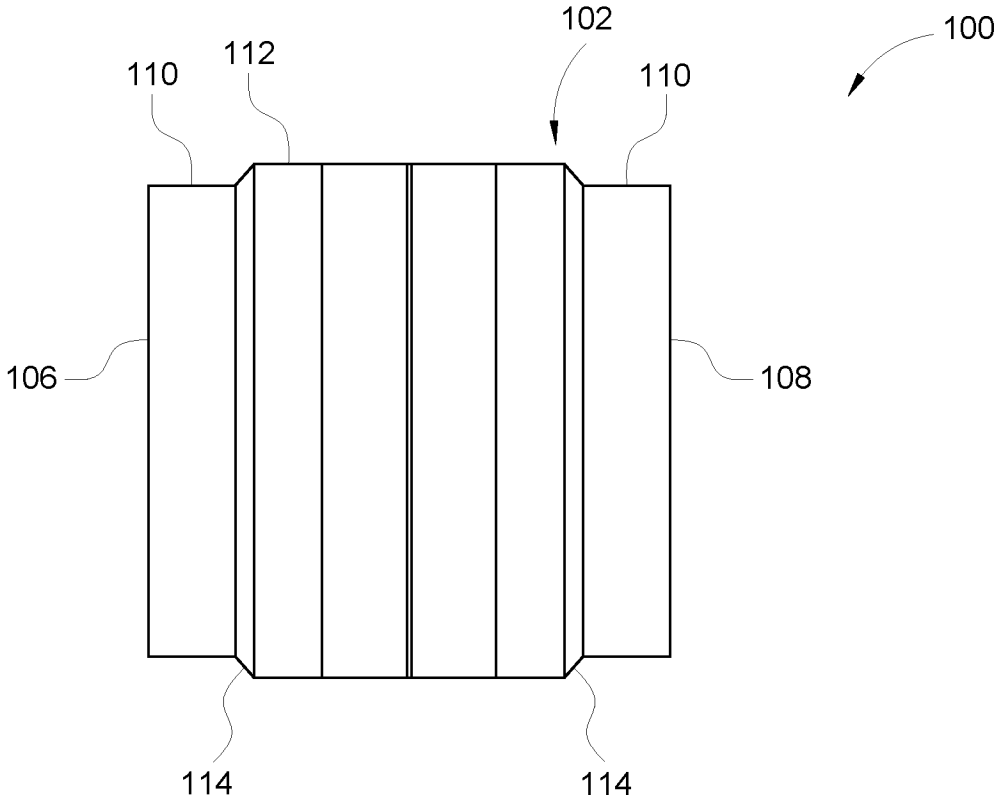
FIG. 2 illustrates a side planar view of the carrier.

FIG. 2 illustrates a side planar view of the carrier 100. Referring to FIGS. 1-2 in combination, it may be seen that the housing 102 includes two ends, a first end 106 and a second end 108. Herein, the first end 106 is considered as a front end of the housing 102 and the second end 108 is considered as a rear end of the housing 102. As may be seen, the housing 102 includes grooves formed at the two ends 106 and 108 thereof, to provide first faces 110 at the two ends 106 and 108. It may be appreciated that the grooves may be formed by turning of the cylindrical housing 102, for example, by using a lathe machine or the like. Such techniques for turning of cylindrical surfaces are well known in the art and have not been described herein. Further, the housing 102 includes a second face 112 located between the two first faces 110 at the ends 106 and 108. As illustrated in FIG. 2, transitional edges 114 between the first faces 110 and the second face 112 may be chamfered, i.e. sloped.

Figure 3:
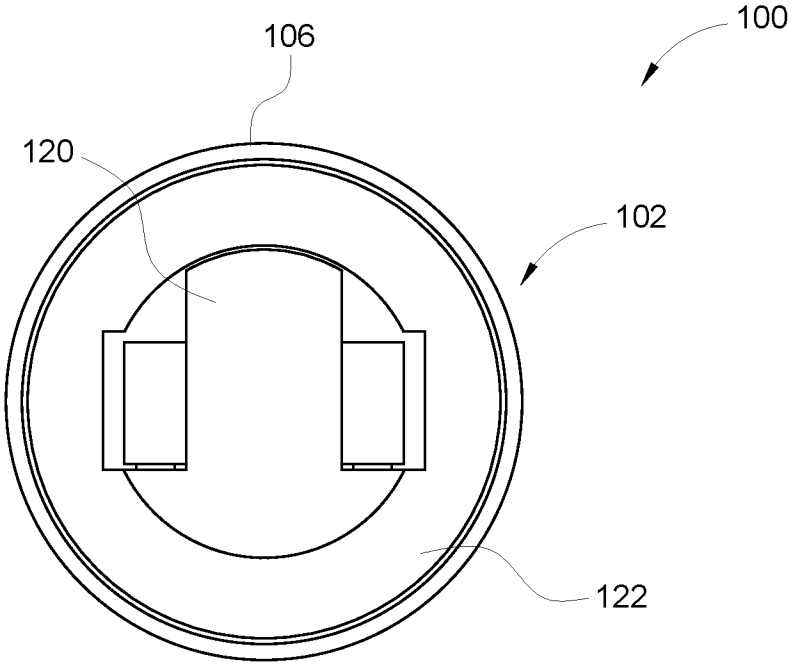
FIG. 3 illustrates a front planar view of the carrier.

Referring back to FIG. 1, it may be seen that the housing 102 is a hollow cylindrical structure, providing a space 118 inside the carrier 100 for accommodating various components therein. As illustrated, the carrier 100 includes a pillar 120 inside the space 118. In particular, the pillar 120 is located towards the first end 108 of the housing 102, in the carrier 100. FIG. 3 illustrates a front planar view of the carrier 100, that is a planar view of the carrier 100 as if seeing the first end 106 thereof. As illustrated, the pillar 120 may be generally extending from an inner wall 122 of the housing 102, behind the front face 110 (as may be better seen from FIG. 4). The pillar 120 may be connected to the inner wall 122 from one side thereof. As discussed, the pillar 120 is used for mounting of the wrist watch in the carrier 100, such that back of the wrist watch snugly sits on the pillar 120. In the illustrated examples, the pillar 120 is shown to be generally a rectangular structure; however, it may be appreciated that the pillar 120 may have any other shape suitable for accommodating the wrist watch thereon, without departing from the spirit and scope of the present disclosure.

Figure 4:
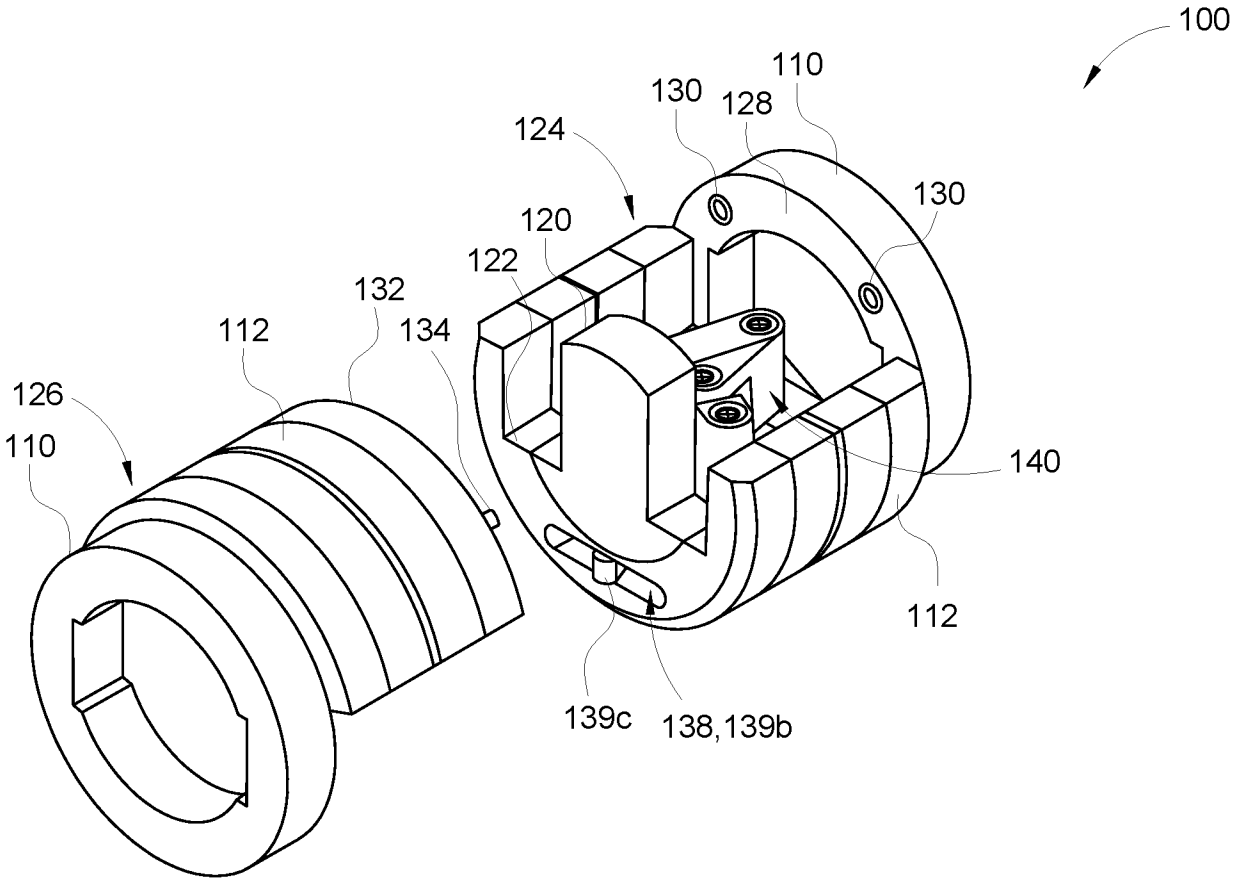
FIG. 4 illustrates a left-perspective view of the carrier in dissembled form.
Figure 5:
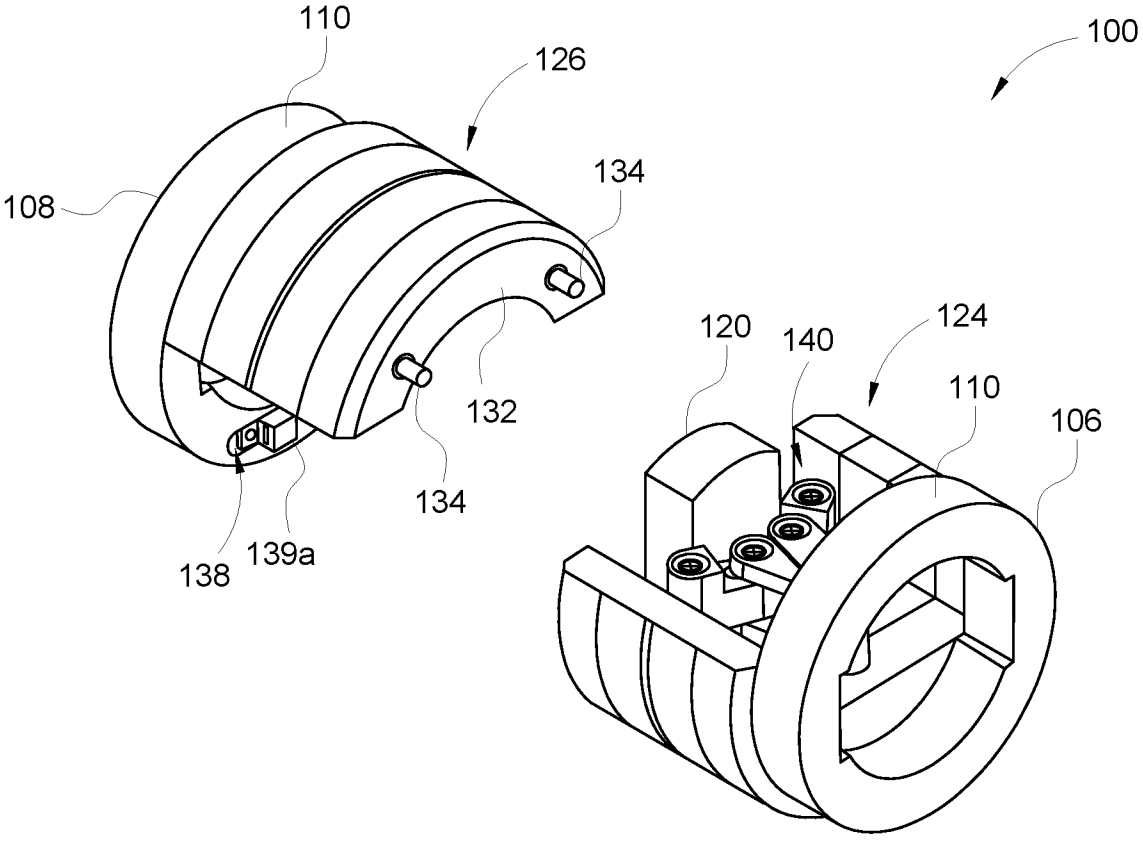
FIG. 5 illustrates a right-perspective view of the carrier in dissembled form.

FIG. 4 illustrates a left-perspective view of the carrier 100 in dissembled form; and FIG. 5 illustrates a right-perspective view of the carrier in dissembled form. As illustrated in FIGS. 4-5, the carrier 100, and the corresponding housing 102, is a two-piece structure. The carrier 100 includes a first half-cylindrical structure 124 and a second half-cylindrical structure 126. It may be appreciated that the first half-cylindrical structure 124 and the second half-cylindrical structure 126 may substantially be halves of the carrier 100, or the housing 102 thereof, but may not necessarily be exact halves. It may be seen that the first half-cylindrical structure 124 includes one of the first face 110, about half of the second face 112 of the housing 102; and the second half-cylindrical structure 126 includes other of the first face 110, other half of the second face 112 of the housing 102.

As illustrated in FIGS. 4-5, the first half-cylindrical structure 124 have the pillar 120 arranged therein. Further, as may be seen, the portion corresponding to the first face 110 of the housing 102 provides an annular ring having a distal peripheral face 128 of the first half-cylindrical structure 124. One or more pin sleeves 130 are arranged along the distal peripheral face 128 of the first half-cylindrical structure 124. The pin sleeves 130 may be in the form of holes formed in the distal peripheral face 128. Further, as illustrated, the second half-cylindrical structure 126 provides a distal peripheral face 132. The second half-cylindrical structure 126 have one or more pins 134, corresponding to the one or more pin sleeves 130, arranged along the distal peripheral face 132. It may be appreciated that the one or more pins 134 and the one or more pin sleeves 130 are arranged complementary to each other to allow for engagement thereof, when the first half-cylindrical structure 124 and the second half-cylindrical structure 126 are bought close together and coupled with each other, to assemble the carrier 100. It may be appreciated that the second half-cylindrical structure 126 is adapted to slide onto the first half-cylindrical structure 124 such that the one or more pins 134 are received in the corresponding one or more pin sleeves 130 to align the distal peripheral face 128 of the first half-cylindrical structure 124 with the distal peripheral face 132 of the second half-cylindrical structure 126. The one or more pins 134 and the one or more pin sleeves 130 are designed to have close tolerances with respect to each other for providing proper engagement of the first half-cylindrical structure 124 and the second half-cylindrical structure 126.

Further, as illustrated, the carrier 100 comprises a catch mechanism 138 provided between the first half-cylindrical structure 124 and the second half-cylindrical structure 126. In one example, the catch mechanism 138 is a ball catch mechanism, as well known in the art. Such catch mechanism 138 includes one or more protrusions 139*a* provided in the second half-cylindrical structure 126 which may be complementary to be inserted into a slot 139*b* formed in the first half-cylindrical structure 124 to be caught by a catcher 139*c* therein. When the first half-cylindrical structure 124 and the second half-cylindrical structure 126 are coupled, the protrusions 139*a* are received in the slot 139*b* and held by the catcher 139*c* to further enhance engagement of the first half-cylindrical structure 124 and the second half-cylindrical structure 126 together. In other examples, the one or more protrusions 139*a* of the catch mechanism 138 may be magnetic and the catcher 139*c* may further have magnetic properties to releasably couple the first half-cylindrical structure 124 and the second half-cylindrical structure 126 together, when the protrusions 139*a* are received in the slot 139*b*.

Figure 6:
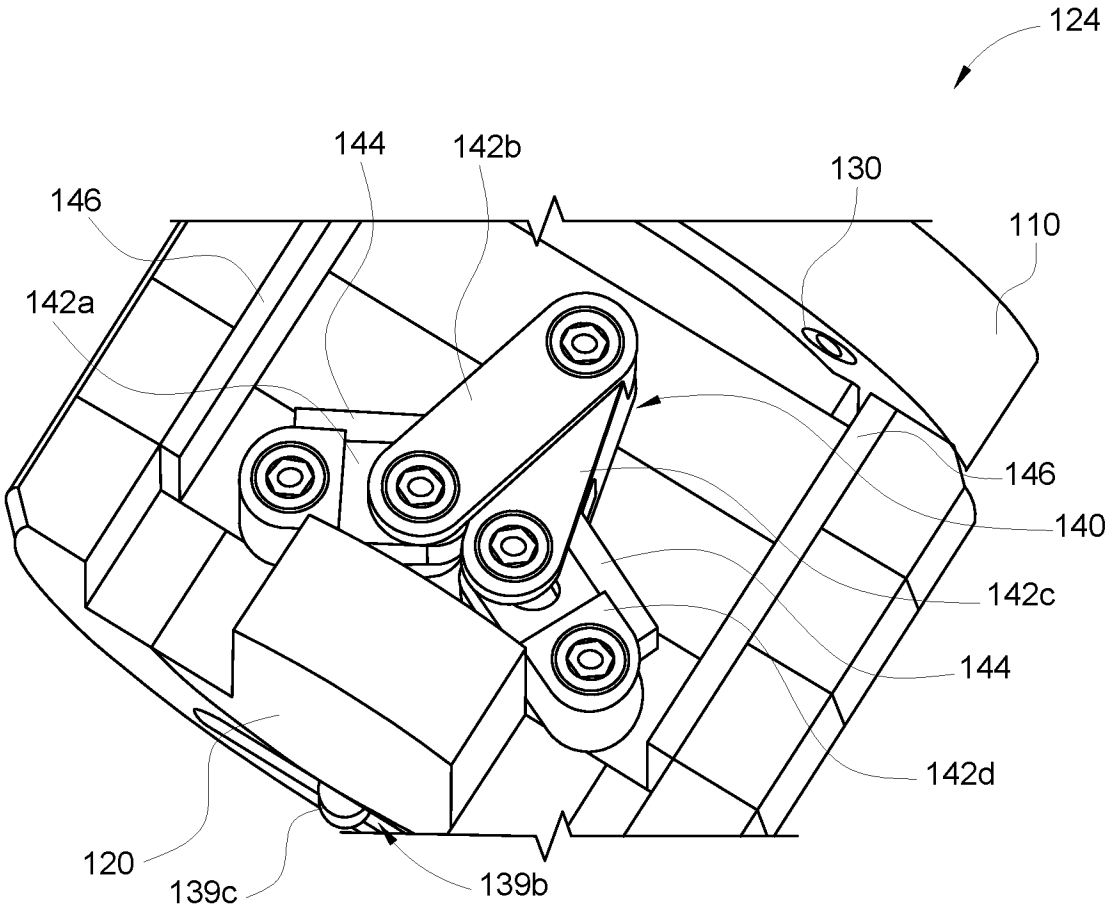
FIG. 6 illustrates a partial perspective view of a first half-cylindrical structure of the carrier with a bracelet holding mechanism disposed in open position thereof.
Figure 7:
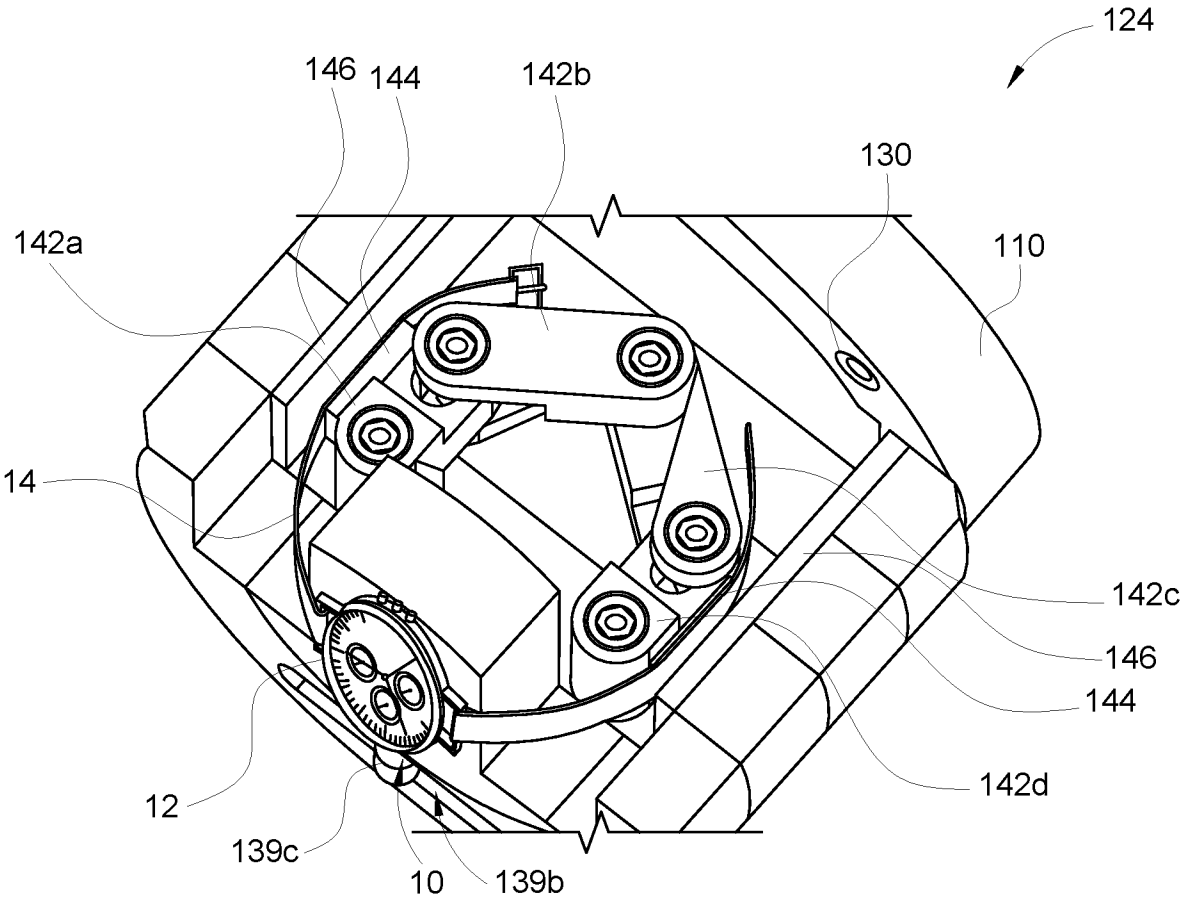
FIG. 7 illustrates a partial perspective view of the first half-cylindrical structure of the carrier with the bracelet holding mechanism disposed in closed position thereof.

According to embodiments of the present disclosure, as illustrated in FIGS. 4-5, the carrier 100 includes a bracelet holding mechanism 140. The bracelet holding mechanism 140 is arranged inside the housing 102. In particular, the bracelet holding mechanism 140 is arranged inside the first half-cylindrical structure 124. FIG. 6 illustrates a partial perspective view of the first half-cylindrical structure 124 of the carrier 100 with the bracelet holding mechanism 140 disposed in open position thereof; and FIG. 7 illustrates a partial perspective view of the first half-cylindrical structure 124 of the carrier 100 with the bracelet holding mechanism 140 disposed in closed position thereof. In one embodiment, the bracelet holding mechanism 140 is a spring-loaded bistable mechanism. As illustrated in FIGS. 6-7, the bracelet holding mechanism 140 includes pivotally connected arms, namely a first arm 142*a*, a second arm 142*b*, a third arm 142*c* and a fourth arm 142*d*; with the first arm 142*a* and the second arm 142*b* pivotally connected to each other, the second arm 142*b* and the third arm 142*c* pivotally connected to each other, and the third arm 142*c* and the fourth arm 142*d* pivotally connected to each other. Also, as illustrated, the bracelet holding mechanism 140 comprises one cushioning piece 144 lined on one side thereof facing the inner wall 122, and another cushioning piece 146 lined on corresponding portion of the inner wall 122, on each of the opposing sides thereof. In the present examples, the cushioning pieces 144 and 146 are rubber foam pieces.

As may be seen from FIG. 7, the bracelet is snugly supported in the gap with the bracelet holding mechanism 140 disposed in the closed position thereof, including wristwatch 12 mounted therein. As discussed, the bracelet holding mechanism 140 is adapted to be switched between a closed position and an open position. In the open position of the bracelet holding mechanism 140 (as illustrated in FIG. 6), the first arm 142*a* and the fourth arm 142*d* are at a substantial distance from the inner wall 122 of the housing 102 of the carrier 100, while in the closed position of the bracelet holding mechanism 140 (as illustrated in FIG. 7), the first arm 142*a* and the fourth arm 142*d* are at a reduced distance from the inner wall 122 of the housing 102 of the carrier 100. Therefore, in the open position, the bracelet holding mechanism 140 is disposed providing a gap with respect to the inner wall 122; and in the closed position, the bracelet holding mechanism 140 is disposed with the said gap being narrower with respect to the inner wall 122. With the cushioning pieces 144 and 146, such arrangement of the bracelet holding mechanism 140 in the closed position snugly support the bracelet between the two cushioning pieces 144 and 146. It may further be contemplated that although one particular type of the spring-loaded bistable mechanism is explained for the bracelet holding mechanism 140; any other suitable type of bistable mechanism may be implemented without departing from the scope of the present disclosure.

It may be appreciated that a user may simply push or pull the bracelet holding mechanism 140 from connection point between the second arm 142*b* and the third arm 142*c* to cause the bracelet holding mechanism 140 to be switched between the closed position and the open position. Alternatively, in some examples, the bracelet holding mechanism 140 may include an operating switch (not shown). The operating switch is implemented for switching the bracelet holding mechanism 140 between the open position and the closed position thereof. For this purpose, the operating switch may be manually moved. Such operation of the operating switch for operating the spring-loaded bistable mechanism of the bracelet holding mechanism 140 may be contemplated by a person skilled in the art and thus has not been explained herein for the brevity of the present disclosure.

Figure 8:
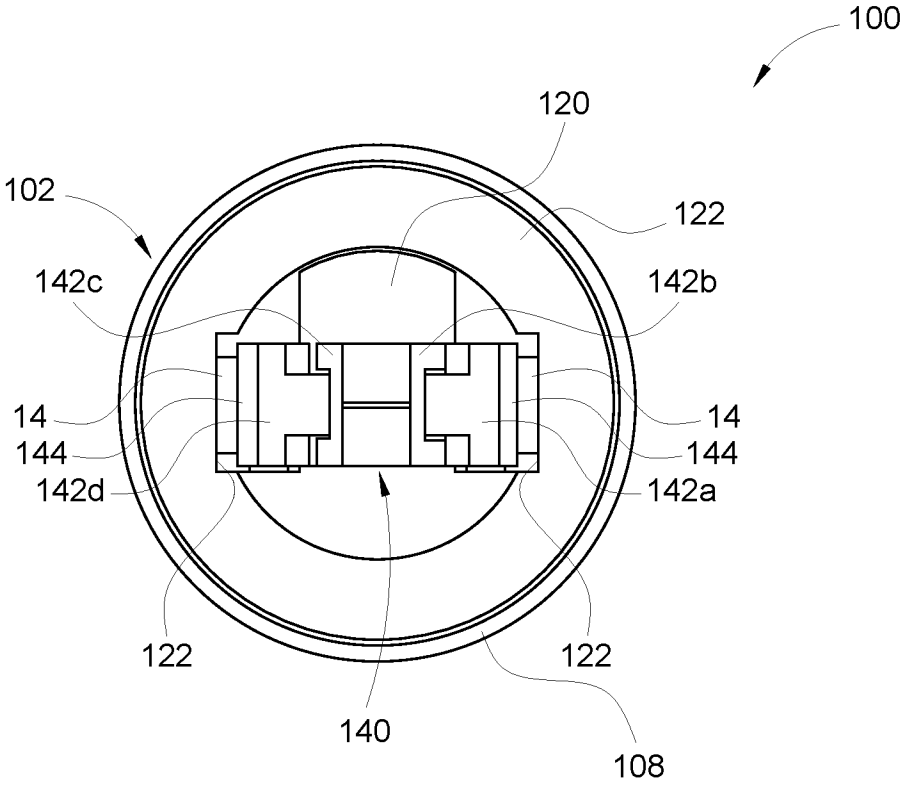
FIG. 8 illustrates a back planar view of the carrier.
Figure 9:
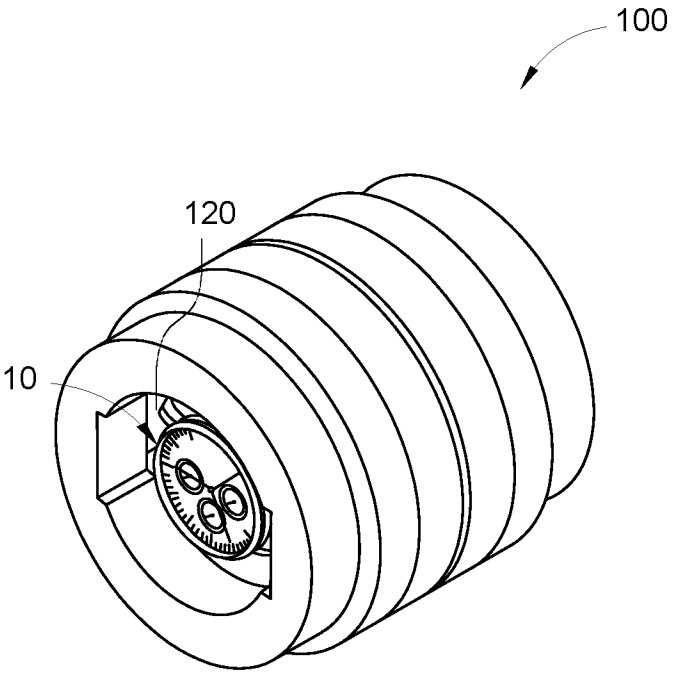
FIG. 9 illustrates a perspective view of the carrier with the wrist watch mounted therein.

FIG. 8 illustrates a back planar view of the carrier 100, that is a planar view of the carrier 100 as if seeing the second end 108 thereof. Further, FIG. 9 illustrates a perspective view of the carrier with the wrist watch (referred by the numeral 10) mounted therein. As discussed, the pillar 120 is used for mounting of the wrist watch 10 in the carrier 100, such that the wrist watch 10 sits on the pillar 120 (as depicted in FIG. 9). In particular, the carrier 100 is adapted to receive the wrist watch 10 therein with a bracelet of the wrist watch 10 slid through the gap between the bracelet holding mechanism 140 and the inner wall 122, while the bracelet holding mechanism 140 is disposed in the open position thereof. Thus, in the carrier 100, and particularly the first half-cylindrical structure 124, the pillar 120 is arranged with respect to the bracelet holding mechanism 140 such that the wrist watch 10 rests on the pillar 120 when mounted in the carrier 100 with the bracelet extending from sides of the pillar 120 towards the bracelet holding mechanism 140.

Figure 10:
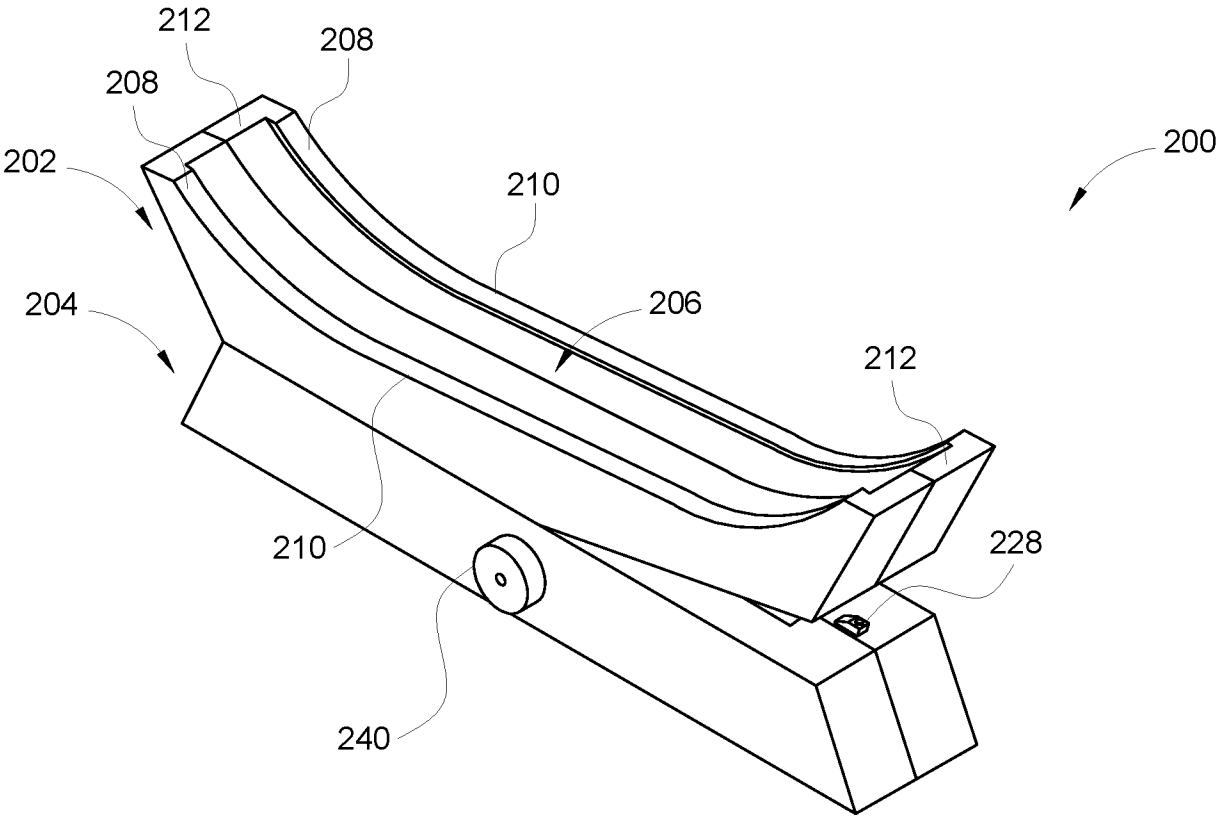
FIG. 10 illustrates a perspective view of a rocker device adapted to allow placement of the carrier thereon.

Moving on, FIG. 10 illustrates a perspective view of a rocker device 200 adapted to allow placement of the carrier 100 (as discussed in reference to FIGS. 1-9, in the preceding paragraphs) thereon. As illustrated, the rocker device 200 includes a first block 202 and a second block 204. The second block 204 pivotally supports the first block 202 thereon (as discussed in detail later). The first block 202 includes a rolling surface 206 adapted to allow placement of the carrier 100 thereon. As may be seen, the rolling surface 206 have guide rails 208 defined therein to prevent the carrier 100 from rolling off from lateral sides 210 thereof. Further, as may be seen, the rolling surface 206 is curved to prevent the carrier 100 from rolling off from the longitudinal ends 212 thereof.

Figure 11:
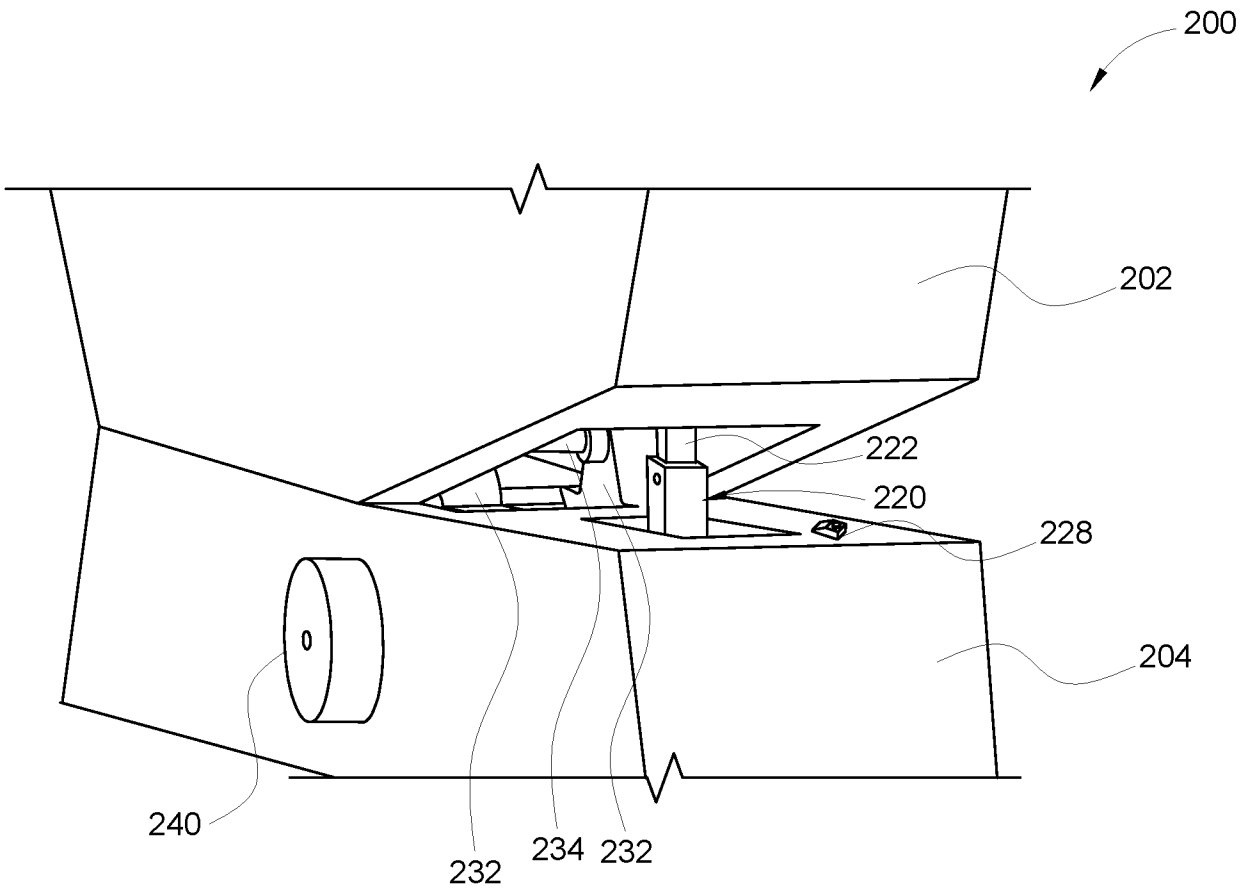
FIG. 11 illustrates a partial perspective view of the rocker device showing an actuation mechanism therein.
Figure 12:
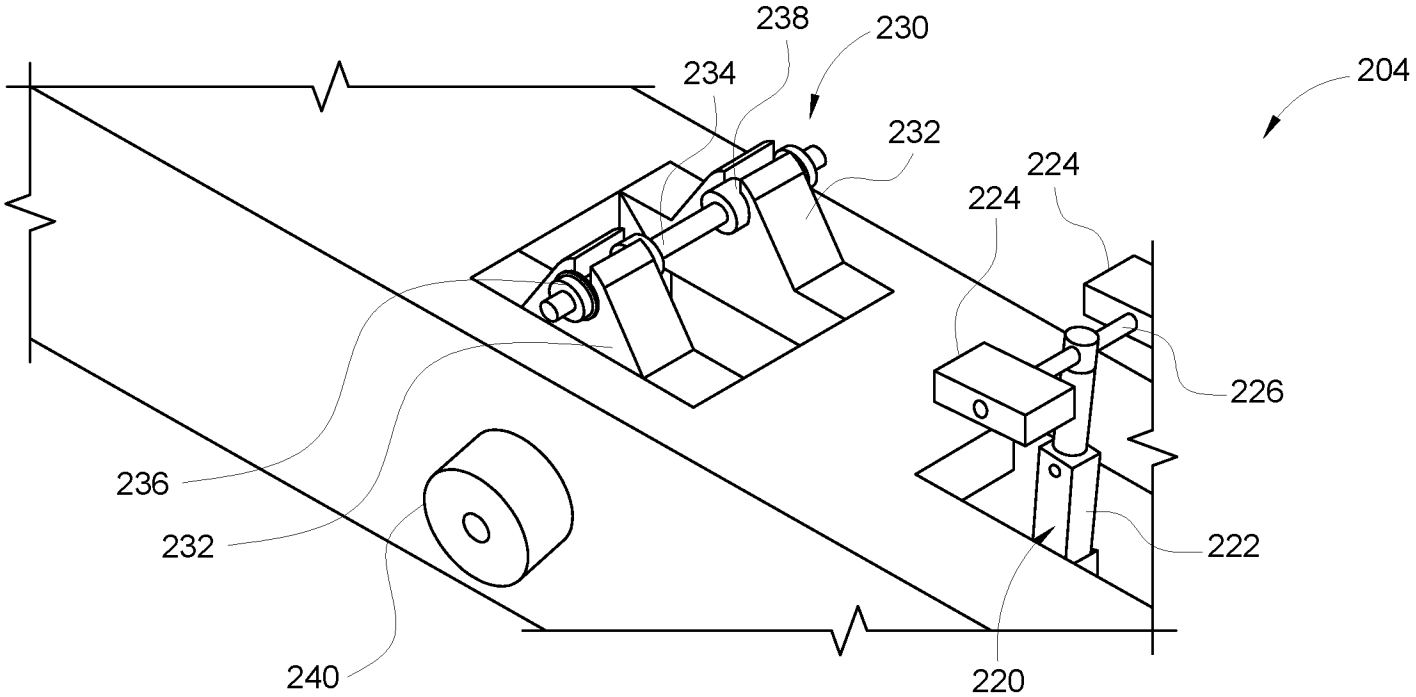
FIG. 12 illustrates a partial perspective view of a second block of the rocker device showing the actuation mechanism therein and a mounting arrangement therein.
Figure 13:
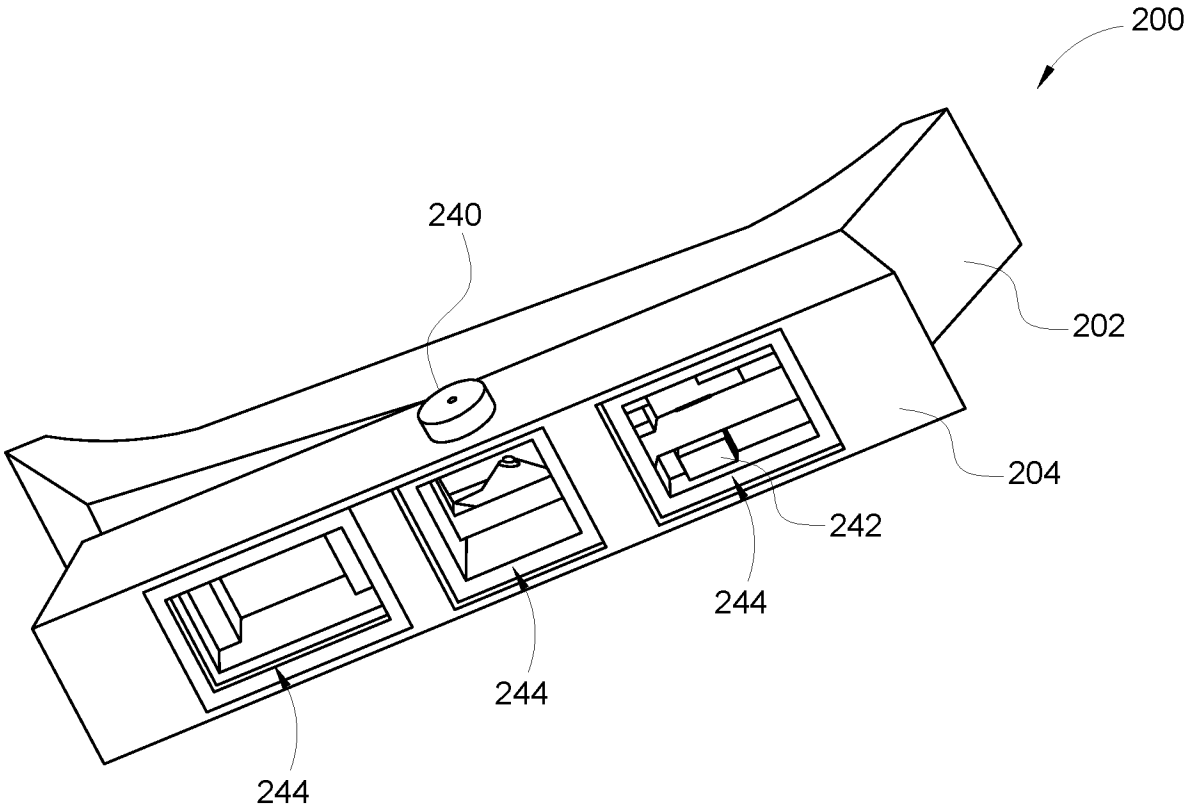
FIG. 13 illustrates a bottom perspective view of the rocker device.

FIG. 11 illustrates a partial perspective view of the rocker device 200. FIG. 12 illustrates a partial perspective view of the second block 204 of the rocker device 200, in more detail. Referring to FIGS. 11-12, as illustrated, the rocker device 200 includes an actuation mechanism 220 arranged between the first block 202 and the second block 204. The actuation mechanism 220 is configured to cause rocking of the first block 202, with respect to the second block 204. In particular, the actuation mechanism 220 includes an actuator 222 fixed to a top side of the second block 204 from one end thereof and to a bottom side of the first block 202 from other end thereof. Herein, the actuator 222 is a linear actuator. The actuator 222 is configured to extend and retract to cause rocking of the first block 202 with respect to the second block 204. Such linear actuators and their working may easily be contemplated by a person skilled in the art and thus have not been described herein for the brevity of the present disclosure. Further, it may be appreciated by a person skilled in the art that similar results could be achieved with alternate actuator implementations such as cams and followers, rack and pinion mechanisms, etc. In some examples, the actuation mechanism 220 may optionally include rubber pieces 224 arranged on top of the actuator 222 by means of a horizontal arm 226. The rubber pieces 224 may support the bottom side of the first block 202 thereon, and may help to prevent audible noise due to rocking movement and force acting against the bottom side of the first block 202 when the actuator 222 extends and retracts.

Further, as illustrated, the actuation mechanism 220 also includes at least one limit switch 228 (also illustrated in FIG. 10) provided on the top side of the second block 204. Specifically, the actuation mechanism 220 includes two limit switches 228 provided proximal to longitudinal ends of the top side of the second block 204. The limit switch 228 is located so as to be depressed when the bottom side of the first block 202 comes in contact with the top side of the second block 204 while rocking. The limit switch 228 is configured to generate a signal on depression thereof. The limit switch 228 is communicably coupled to the actuator 222 so as to cause the actuator to switch from extension thereof to retraction and vice-versa, when the signal is generated. This way the actuation mechanism 220 sustains the rocking motion of the first block 202 with respect to the second block 204, in the rocker device 200.

As better illustrated in FIG. 12, the rocker device 200 includes a mounting arrangement 230 for providing the pivotal connection between the first block 202 and the second block 204. The mounting arrangement 230 includes two supports 232 between which a spindle 234 is supported by means of bearings 236 (only one labelled) and collars 238 (only one labelled). It may be appreciated that such mounting arrangement 230, using bearings 236 and collars 234, may provide smooth relative movement, such as rocking movement, between the first block 202 and the second block 204.

Furthermore, as illustrated in FIGS. 10-13, the rocker device 200 includes a control dial 240. The control dial 240 can be implemented by a user to define user-configurable settings for the rocker device 200. The user-configurable settings may include rate of rocking of the first block 202 with respect to the second block 204, which may be controlled by controlling extension and retraction of the actuator 222. For this purpose, the rocker device 200 may include a controller 242 which may be located inside any one of multiple empty spaces 244 in the bottom side of the second block 204. The rotation of the control dial 240 defines the user-configurable setting which, in turn, set the rate of rocking motion of the first block 202, as controlled by the controller 242. The controller 242 may implement one or more of a digital encoder, a switch and a display or lights that allows the user to click, turn and get visual feedback about the user settings. With those options, the user can turn the rocker device 200 ON and OFF, and control how many turns-per-day the wrist watch 10 may get, and how those turns should be distributed along the day, which are commonly available settings in watch winders. It may be appreciated by a person skilled in the art that similar results could be achieved with multiple switches, digital displays, a potentiometer instead of an encoder, etc.

Figure 14:
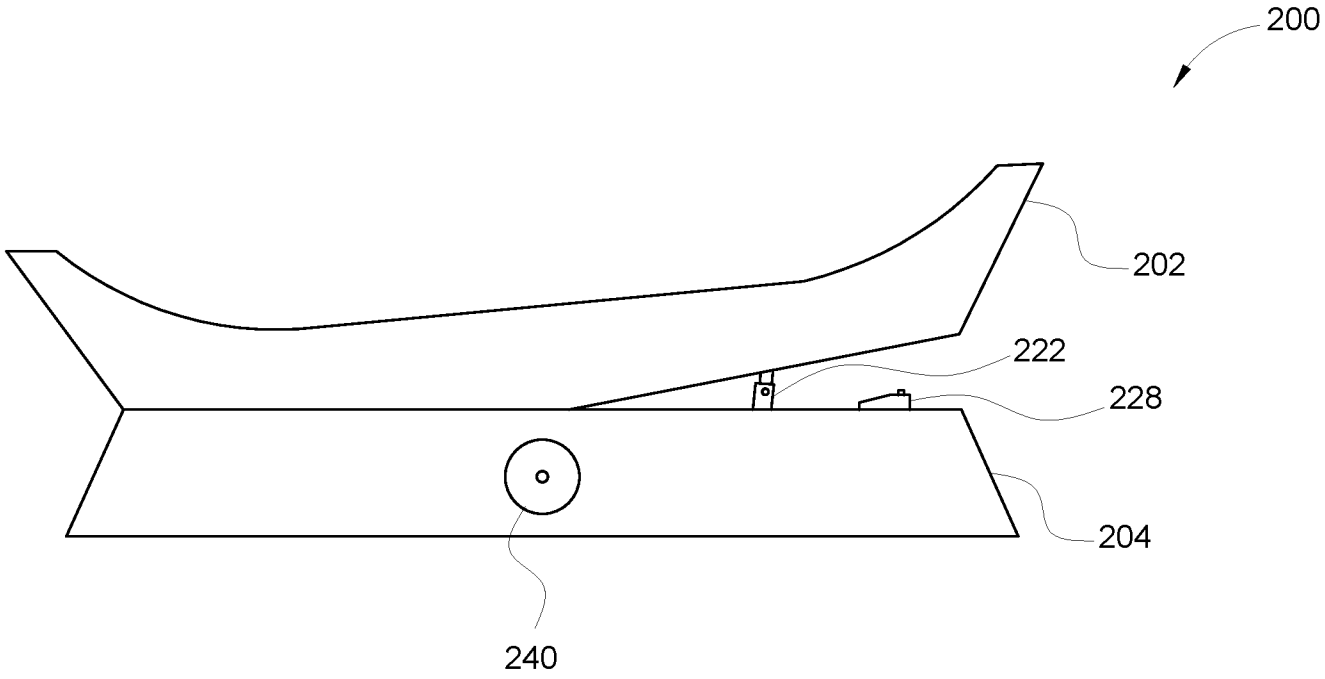
FIGS. 14-15 illustrate front planar views of the rocker device in operation.
Figure 15:
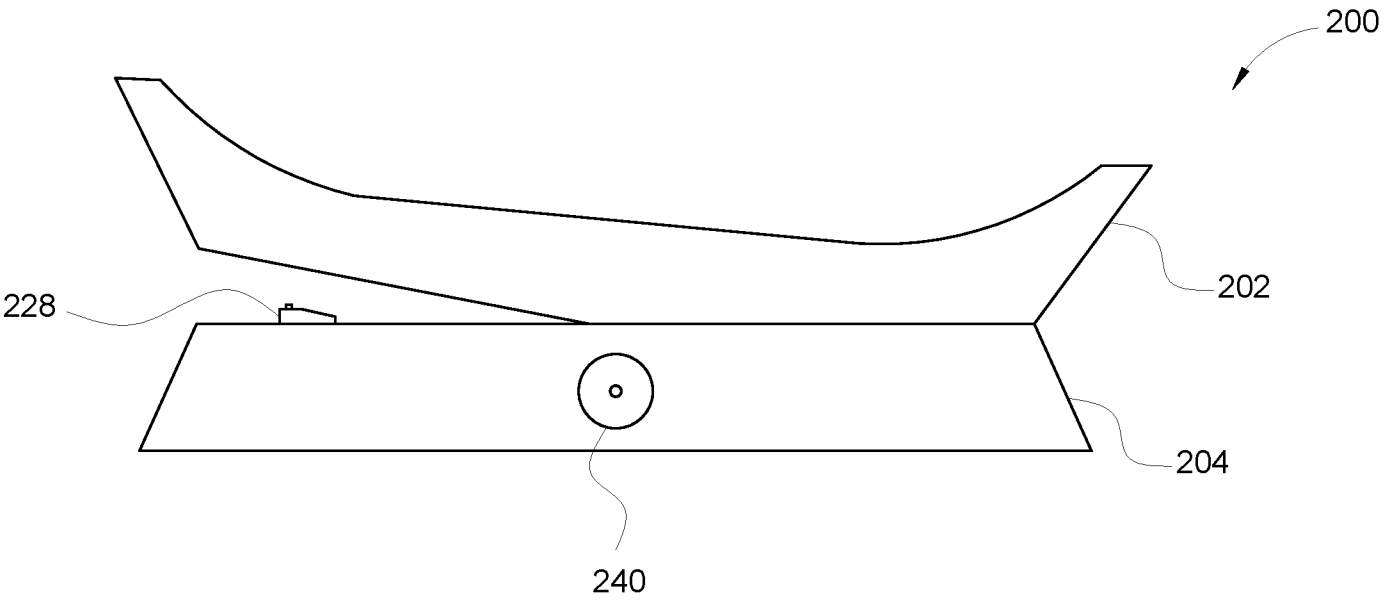

FIGS. 14-15 illustrate front planar views of the rocker device 200 in operation. In particular, in FIGS. 14-15, the rocker device 200 is depicted in extreme stages of the rocking motion thereof. As may be contemplated, the first block 202 of the rocker device 200 provides the rocking motion due to extension and retraction of the actuator 222 and switching thereof due to the use of limit switches 228. It may be appreciated that the electrical energy for powering the extension and retraction of the actuator 222, as well as for powering the electrical circuits of the controller 242, may be provided by a variety of different energy sources, such as a battery or direct power supply (not shown).

Figure 16:
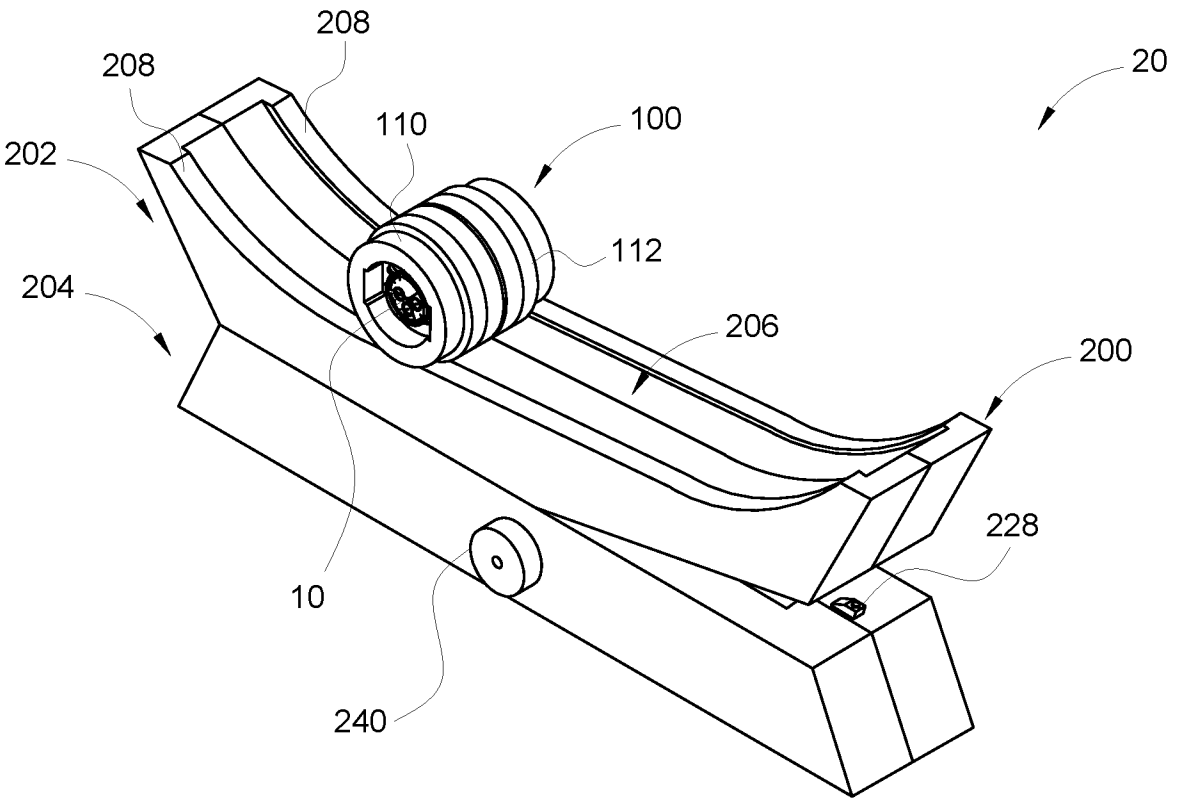
FIG. 16 illustrates a perspective view of a watch winding apparatus having the carrier with the wrist watch placed on the rocker device, in operation.

FIG. 16 illustrates a perspective view of a watch winding apparatus 20 having the carrier 100 with the wrist watch 10 placed on the rocker device 200 in operation. The rocker device 200 is adapted to allow placement of the carrier 100 thereon. The chamfered transitional edges 114 of the carrier 100 engages with the guide rails 208 of the rolling surface 206 to prevent the carrier 100 from rolling off from the lateral sides 210 thereof. The chamfered transitional edges 114 helps to reduce friction and noise when the carrier 100 rolls against the guide rails 208. The rocker device 200 is configured to rotate the carrier 100, based on user-configurable setting, to activate the mechanical self-winding eccentrics for winding of the wrist watch 10 mounted therein. Specifically, the actuation mechanism 220 is configured to cause rocking of the first block 202, with respect to the second block 204, such that the carrier 200 placed on the rolling surface 206 is rolled between two longitudinal ends 212 thereof and rotate thereby. The user-configurable setting may be set based on the mechanical self-winding eccentrics of the wrist watch 10.

The present disclosure further provides a method for winding the wrist watch 10 with mechanical self-winding eccentrics and having a bracelet. The method includes mounting the wrist watch 10 in the carrier 100. The method further includes placing the carrier 100, with the wrist watch 10, on the rolling surface 206 of the rocker device 200. The method further includes actuating the rocker device 200, based on user-configurable setting, to cause rolling, and thereby rotation, of the carrier 100 on the rolling surface 206, to activate the mechanical self-winding eccentrics for winding of the wrist watch 10 mounted therein. Mounting the wrist watch 10 in the carrier 100 involves resting the wrist watch 10 on the pillar 120 in the carrier 100 with the bracelet extending from sides of the pillar 120 to be engaged by the bracelet holding mechanism 140. The method may also include adjusting user-configurable setting of the rocker device 200 to change rate of rolling of the carrier 100 on the rolling surface 206 of the rocker device 200.

Self-winding watches operate as long as there is sufficient physical movement, of the proper form, to actuate internal winding mechanisms contained therein. Oftentimes a watch wearer may not wear the watch, for one reason or the other, and the winding mechanism is not actuated, resulting in the running down and stopping of the watch. During such periods of inactivity, the watch winding apparatus 20 for such automatic watches would be valuable. The watch winding apparatus 20 helps to keep the watch 10 in a constantly wound and functional condition over an extended period of time. The watch winding apparatus 20 may also be used as an ornamental or decorative pieces to be placed on a work table or the like.

In the present watch winding apparatus 20, the bracelet holding mechanism 140 allows the user to place the watch 10 in the carrier 100 with minimal effort, without the need to close the bracelet, in contrast to all commercial winders out there. The user may simply untie/unlock the watch 10, slide the bracelet in the bracelet holding mechanism 140 while in open position, subsequently engage the bracelet holding mechanism 140 to be disposed in closed position thereof, and then place the carrier 100 with the wrist watch 10, on the rolling surface 206 of the rocker device 200; without the need of fiddling around to lock/close the bracelet when positioned in the carrier 100.

In light of the above, the present disclosure provides, a watch winding apparatus and a method for winding a wrist watch with mechanical self-winding eccentrics and having a bracelet.

All references, including publications, patent applications, and patents, cited herein are hereby incorporated by reference to the same extent as if each reference were individually and specifically indicated to be incorporated by reference and were set forth in its entirety herein.

The detailed description set forth herein in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments.

This detailed description of illustrative embodiments includes specific details for providing a thorough understanding of the presently disclosed subject matter. However, it will be apparent to those skilled in the art that the presently disclosed subject matter may be practiced without these specific details. In some instances, well-known structures and devices are shown in block diagram form in order to avoid obscuring the concepts of the presently disclosed method and system.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. A watch winding apparatus for winding a wrist watch with mechanical self-winding eccentrics and having a bracelet, the watch winding apparatus comprising:

a carrier adapted for mounting the wrist watch therein, the carrier comprising:

a hollow cylindrical housing with an inner wall; and a bracelet holding mechanism arranged inside the hollow cylindrical housing, the bracelet holding mechanism comprising:

a first arm, a second arm, a third arm and a fourth arm, with the first arm and the second arm pivotally connected to each other, the second arm and the third arm pivotally connected to each other, and the third arm and the fourth arm pivotally connected to each other, wherein the bracelet holding mechanism is adapted to be pushed or pulled from connection point between the second arm and the third arm to cause the bracelet holding mechanism to be switched between a closed position and an open position thereof, such that in the open position thereof, the bracelet holding mechanism is disposed providing a gap with respect to the inner wall, and in the closed position thereof, the bracelet holding mechanism is disposed with the gap being narrower with respect to the inner wall, and wherein the carrier is adapted to receive the wrist watch therein with the bracelet being slided through the gap between the bracelet holding mechanism and the inner wall while the bracelet holding mechanism is disposed in the open position thereof, and the bracelet being snugly supported in the gap with the bracelet holding mechanism disposed in the closed position thereof; and a rocker device adapted to allow placement of the carrier thereon, the rocker device configured to rotate the carrier, based on user-configurable setting, to activate the mechanical self-winding eccentrics for winding of the wrist watch mounted therein.

2. The watch winding apparatus of claim 1, wherein:

in the open position of the bracelet holding mechanism, the first arm and the fourth arm are at a substantial distance from the inner wall of the housing of the carrier such that the bracelet holding mechanism is disposed providing the gap with respect to the inner wall, and in the closed position of the bracelet holding mechanism, the first arm and the fourth arm are at a reduced distance from the inner wall of the housing of the carrier such that the bracelet holding mechanism is disposed with the gap being narrower with respect to the inner wall.

3. The watch winding apparatus of claim 1, wherein the bracelet holding mechanism further comprises one cushioning piece lined on one side thereof facing the inner wall, and another cushioning piece lined on corresponding portion of the inner wall, to snugly support the bracelet between the two cushioning pieces.

4. The watch winding apparatus of claim 1, wherein the carrier comprises a pillar arranged with respect to the bracelet holding mechanism such that the wrist watch rests on the pillar when mounted in the carrier with the bracelet extending from sides of the pillar towards the bracelet holding mechanism.

5. The watch winding apparatus of claim 4, wherein the carrier is a two-piece structure, and comprises:

a first half-cylindrical structure having the bracelet holding mechanism arranged therein and the pillar arranged therein, and one or more pin sleeves arranged along a distal peripheral face thereof; and a second half-cylindrical structure having one or more pins, corresponding to the one or more pin sleeves, arranged along a distal peripheral face thereof, wherein the second half-cylindrical structure is adapted to slide onto the first half-cylindrical structure such that the one or more pins are received in the corresponding one or more pin sleeves to align the distal peripheral face of the first half-cylindrical structure with the distal peripheral face of the second half- cylindrical structure.

6. The watch winding apparatus of claim 5 further comprising a catch mechanism provided between the first half-cylindrical structure and the second half- cylindrical structure to releasably couple the first half-cylindrical structure and the second half-cylindrical structure, in the carrier.

7. The watch winding apparatus of claim 1, wherein the rocker device comprises:

a first block with a rolling surface adapted to allow placement of the carrier thereon;

a second block pivotally supporting the first block thereon; and an actuation mechanism arranged between the first block and the second block, the actuation mechanism configured to cause rocking of the first block, with respect to the second block, such that the carrier placed on the rolling surface is rolled between two longitudinal ends thereof and rotate thereby.

8. The watch winding apparatus of claim 7, wherein the actuation mechanism comprises:

an actuator fixed to a top side of the second block from one end thereof and to a bottom side of the first block from other end thereof, wherein the actuator is configured to extend and retract, based on user-configurable setting, to cause rocking of the first block; and at least one limit switch provided on the top side of the second block such that the at least one limit switch is depressed when the bottom side of the first block comes in contact with the top side of the second block while rocking, wherein the at least one limit switch generates a signal on depression thereof to cause the actuator to switch from extension thereof to retraction and vice-versa.

9. The watch winding apparatus of claim 7, wherein the rolling surface have guide rails defined therein to prevent the carrier from rolling off from lateral sides thereof.

10. The watch winding apparatus of claim 7, wherein the rolling surface is curved to prevent the carrier from rolling off from the longitudinal ends thereof.

11. A carrier for mounting a wrist watch, having a bracelet, therein, the carrier comprising:

a hollow cylindrical housing with an inner wall; and a bracelet holding mechanism arranged inside the hollow cylindrical housing, the bracelet holding mechanism comprising:

a first arm, a second arm, a third arm and a fourth arm, with the first arm and the second arm pivotally connected to each other, the second arm and the third arm pivotally connected to each other, and the third arm and the fourth arm pivotally connected to each other, wherein the bracelet holding mechanism is adapted to be pushed or pulled from connection point between the second arm and the third arm to cause the bracelet holding mechanism to be switched between a closed position and an open position thereof, such that in the open position thereof, the bracelet holding mechanism is disposed providing a gap with respect to the inner wall, and in the closed position thereof, the bracelet holding mechanism is disposed with the gap being narrower with respect to the inner wall, and wherein the carrier is adapted to receive the wrist watch therein with the bracelet being slided through the gap between the bracelet holding mechanism and the inner wall while the bracelet holding mechanism is disposed in the open position thereof, and the bracelet being snugly supported in the gap with the bracelet holding mechanism disposed in the closed position thereof.

12. The carrier of claim 11, wherein:

in the open position of the bracelet holding mechanism, the first arm and the fourth arm are at a substantial distance from the inner wall of the housing of the carrier such that the bracelet holding mechanism is disposed providing the gap with respect to the inner wall, and in the closed position of the bracelet holding mechanism, the first arm and the fourth arm are at a reduced distance from the inner wall of the housing of the carrier such that the bracelet holding mechanism is disposed with the gap being narrower with respect to the inner wall.

13. The carrier of claim 11, wherein the bracelet holding mechanism further comprises one cushioning piece lined on one side thereof facing the inner wall, and another cushioning piece lined on corresponding portion of the inner wall, to snugly support the bracelet between the two cushioning pieces.

14. The carrier of claim 11, further comprising a pillar arranged with respect to the bracelet holding mechanism such that the wrist watch rests on the pillar when mounted in the carrier with the bracelet extending from sides of the pillar towards the bracelet holding mechanism.

15. The carrier of claim 14, further comprising:

a first half-cylindrical structure having the bracelet holding mechanism arranged therein and the pillar arranged therein, and one or more pin sleeves arranged along distal peripheral face thereof; and a second half-cylindrical structure having one or more pins, corresponding to the one or more pin sleeves, arranged along a distal peripheral face thereof, wherein the second half-cylindrical structure is adapted to slide onto the first half-cylindrical structure such that the one or more pins are received in the corresponding one or more pin sleeves to align the distal peripheral face of the first half-cylindrical structure with the distal peripheral face of the second half-cylindrical structure.

16. The carrier of claim 15 further comprising a catch mechanism provided between the first half-cylindrical structure and the second half-cylindrical structure to releasably couple the first half-cylindrical structure and the second half-cylindrical structure therein.

17. A method for winding a wrist watch with mechanical self-winding eccentrics and having a bracelet, comprising:

providing a carrier comprising a hollow cylindrical housing with an inner wall and a bracelet holding mechanism, the bracelet holding mechanism comprising a first arm, a second arm, a third arm and a fourth arm, with the first arm and the second arm pivotally connected to each other, the second arm and the third arm pivotally connected to each other, and the third arm and the fourth arm pivotally connected to each other;

disposing the bracelet holding mechanism in the open position thereof, such that the first arm and the fourth arm are at a substantial distance from the inner wall of the housing of the carrier and the bracelet holding mechanism is disposed providing a gap with respect to the inner wall;

receiving the wrist watch in the carrier with the bracelet being slided through the gap between the bracelet holding mechanism and the inner wall while the bracelet holding mechanism is disposed in the open position thereof;

pulling from connection point between the second arm and the third arm to cause the bracelet holding mechanism to switch to a closed position thereof such that the first arm and the fourth arm are at a reduced distance from the inner wall of the housing of the carrier and the bracelet holding mechanism is disposed with the gap being narrower with respect to the inner wall, and the bracelet being snugly supported in the gap with the bracelet holding mechanism disposed in the closed position thereof;

placing the carrier, with the wrist watch, on a rolling surface of a rocker device; and actuating the rocker device, based on user-configurable setting, to cause rolling, and thereby rotation, of the carrier on the rolling surface, to activate the mechanical self-winding eccentrics for winding of the wrist watch mounted therein.

18. The method of claim 17, wherein receiving the wrist watch in the carrier involves resting the wrist watch on a pillar in the carrier with the bracelet extending from sides of the pillar to be engaged by the bracelet holding mechanism.

19. The method of claim 17 further comprising adjusting user-configurable setting of the rocker device to change rate of rolling of the carrier on the rolling surface of the rocker device.

* * * * *